US005740824A

United States Patent [19]

Tang

[11] Patent Number: 5,740,824

[45] Date of Patent: Apr. 21, 1998

[54] UMBRELLA WITH A STRETCH STRUCTURE FOR SELECTIVELY COLLECTING RAINWATER

[76] Inventor: Yoan Tang, 7F-5, No. 86, An-Ping Road, Chung-Ho, Taipei, Taiwan

[21] Appl. No.: 760,369

[22] Filed: Dec. 4, 1996

[51] Int. Cl.[6] ..... A45B 25/06

[52] U.S. Cl. ..... 135/28; 135/39

[58] Field of Search ..... 135/28, 31, 38, 135/39, 41, 25.1, 25.31, 15.1, 25.33, 27

[56] References Cited

U.S. PATENT DOCUMENTS

| | | | |
|---|---|---|---|
| 1,195,635 | 8/1916 | Altshuler et al. . | |
| 1,628,539 | 5/1927 | Grey | 135/27 X |
| 2,762,383 | 9/1956 | Wittman | 135/28 |
| 3,688,788 | 9/1972 | Weber | 135/28 |
| 4,368,749 | 1/1983 | Lindler et al. | 135/28 X |
| 5,085,239 | 2/1992 | Chin-Hung et al. . | |
| 5,193,566 | 3/1993 | Chen . | |

FOREIGN PATENT DOCUMENTS

| | | | |
|---|---|---|---|
| 1520766 | 4/1968 | France | 135/28 |
| 9168 | 7/1886 | United Kingdom | 135/25.31 |
| 931810 | 7/1963 | United Kingdom | 135/28 |

*Primary Examiner*—Lanna Mai
*Attorney, Agent, or Firm*—Bacon & Thomas

[57] ABSTRACT

Disclosed is an umbrella with a stretch structure for selectively collecting rainwater mainly including a stick with a handle, an upper hub member and a lower hub member vertically movably put around the stick to respectively pivotally connect umbrella main and secondary ribs around them, and an umbrella cover fixed to and centered at a top end of the stick with its outer edge connected to outer ends of the main ribs and a middle portion to outer ends of the secondary ribs. The upper hub member has a downward extended retaining block to detachably engage with a control block pivotally connected to a push-button switch fixed to one side of a lower tube portion of the lower hub member. A push pin is provided to a lower end of the tube portion to selectively extend into different holes formed on the stick. Whereby, when the upper and the lower hub members are locked together by the engaged retaining block and control block and are pulled down together until the push pin passes and extends into a lower through hole on the stick, the umbrella is closed with the umbrella cover in a folded state for collecting rainwater attached to the umbrella cover.

1 Claim, 7 Drawing Sheets

UMBRELLA WITH A STRETCH STRUCTURE FOR SELECTIVELY COLLECTING RAINWATER

BACKGROUND OF THE INVENTION

1. Field of the Invention

The present invention relates to an umbrella with a stretch structure for selectively collecting rainwater. The stretch structure mainly includes an upper hub member and a lower hub member both movably provided around a stick of the umbrella. The lower hub member has a downward extended tube portion on which a push-button switch with a control block is mounted. By operating the push-button switch, the upper and the lower hub members can either be both fixedly located immediately below a top of the umbrella to stretch the umbrella, or be respectively located at a higher and a lower portion of the stick to close the umbrella, or be both fixedly located at the lower portion of the stick to fold the umbrella cover for collecting rainwater. Moreover, the umbrella main ribs and secondary ribs are respectively connected at inner ends to the upper and the lower hub members by means of steel pins and wire ring, respectively, to allow smooth pivotal movement of the ribs about the steel pins and wire ring.

2. Description of the Prior Art

For a general umbrella, there is not a structure or means for collecting rainwater. On a rainy day, rainwater stayed on the umbrella cover, usually about 1,000 c.c., always wets everywhere in a car or room when the umbrella is closed.

The wetted environment is easily soiled and molded. It is time and labor consuming to clean the wetted and molded environment which apparently has adverse influence on the human health. Polybags are provided at some places on rainy days for wetted umbrellas. Some umbrellas are provided at a top with a rainwater collecting cap. Disadvantages of such polybags and rainwater collecting caps include: additional polybag stand must be provided at the entrance of building; the rainwater collecting cap has limited capacity and water collected therein tends to overflow whenever the umbrella is slightly inclined, therefore, the rainwater collecting cap must be drained before the umbrella is stretched for the next use to avoid being wetted by the collected water; and the used polybags and rainwater collecting caps simply become another waste.

FIG. 7 includes an exploded and an assembled perspectives of a conventional umbrella rib structure. As shown, the rib structure mainly includes a hub member 9 and a plurality of umbrella ribs 94. The hub member 9 is provided at its peripheral surface with an annular horizontal groove 91 and a plurality of radial vertical grooves 92. A wire 93 threading through holes 941 formed at an inner end of the umbrella ribs 94 is positioned in the annular horizontal groove 91 with the inner ends of the umbrella ribs 94 separately located in the radial vertical grooves 92. Two ends of the wire 93 are twisted to form a knot so as to fix the umbrella ribs 94 and the wire 93 to the hub member 9 while the umbrella ribs 94 are allowed to pivotally move up and down about the wire 93 relative to the hub member 9 for stretching or closing the umbrella. Disadvantages of this conventional umbrella rib structure include: 1) the contact area of the holes 941 with the wire 93 tends to become rusted due to rainwater or moisture and prevents the umbrella ribs 94 to move smoothly; 2) the twisted ends of the wire 93 tends to become loose after being used for a long time and results in an unworkable umbrella; 3) the exposed pointed ends of the wire 93 tends to injure people and/or pierce through the umbrella cover; and 4) the wire 93 tends to become rusted and broken and it takes a lot of time to dismount the umbrella ribs from the hub member 9 and the wire 93 to replace a new wire.

Therefore, it is desirable to develop an umbrella stretch structure which can eliminate the disadvantages existed in the conventional umbrellas while adds the umbrella's value by giving the rib structure a longer usable life and the function to collect attached rainwater.

SUMMARY OF THE INVENTION

A primary object of the present invention is to provide an umbrella with a stretch structure for selectively collecting rainwater, so that rainwater attached to the umbrella cover can be automatically collected without overflowing from the folded umbrella cover. The umbrella with rainwater collected in the folded cover can be stretched for the next use at any time without the need to drain the collected rainwater first.

Another object of the present invention is to provide an umbrella with a stretch structure for selectively collecting rainwater wherein the umbrella main ribs, secondary ribs, and hub members may be used in a smooth and durable manner to prolong the usable life of the umbrella.

A further object of the present invention is to provide an umbrella with a stretch structure for selectively collecting rainwater wherein the operation and maintenance of the umbrella can be easily and conveniently performed.

To achieve the above and other objects, the umbrella according to the present invention mainly including an upper hub member and a lower hub member vertically movably put around a stick. The upper hub member and a cover thereof are provided on their inner surfaces with recesses to respectively receive a steel pin therein for pivotally connecting umbrella main ribs around the upper hub member. The lower hub member and a cover thereof are provided on their inner surfaces with an annular groove to receive a steel wire ring therein for pivotally connecting umbrella secondary ribs around the lower hub member. The upper hub member has a downward extended retaining block to detachably engage with a control block pivotally connected to a push-button switch fixed to one side of a lower tube portion of the lower hub member. The upper hub member can be fixedly located at a top end of the stick by a springy retaining hook extending out of the stick, or be locked with the lower hub member by the engaged retaining block and control block. When the locked upper and lower hub members are pulled down together and be retained to a lower end of the stick, the umbrella is closed with its cover in a folded state for collecting rainwater attached to the umbrella cover.

BRIEF DESCRIPTION OF THE DRAWINGS

The technique adopted by the present invention and the features thereof can be best understood by referring to the following preferred embodiment arid the accompanying drawings, wherein.

DETAILED DESCRIPTION OF THE PREFERRED EMBODIMENT

Figure 1:
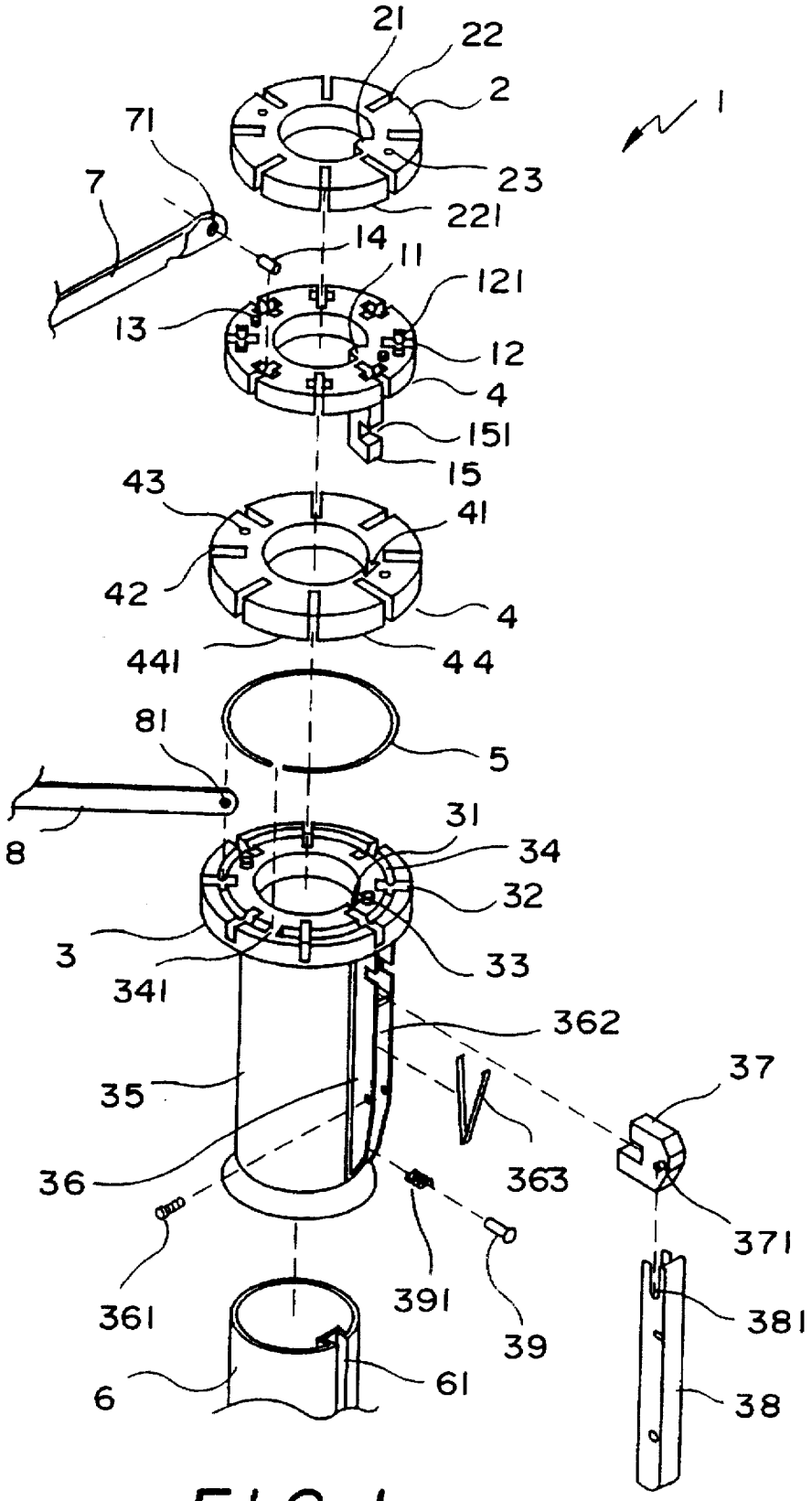
FIG. 1 is an exploded perspective showing the umbrella stretch structure according to the present invention.
Figure 2:
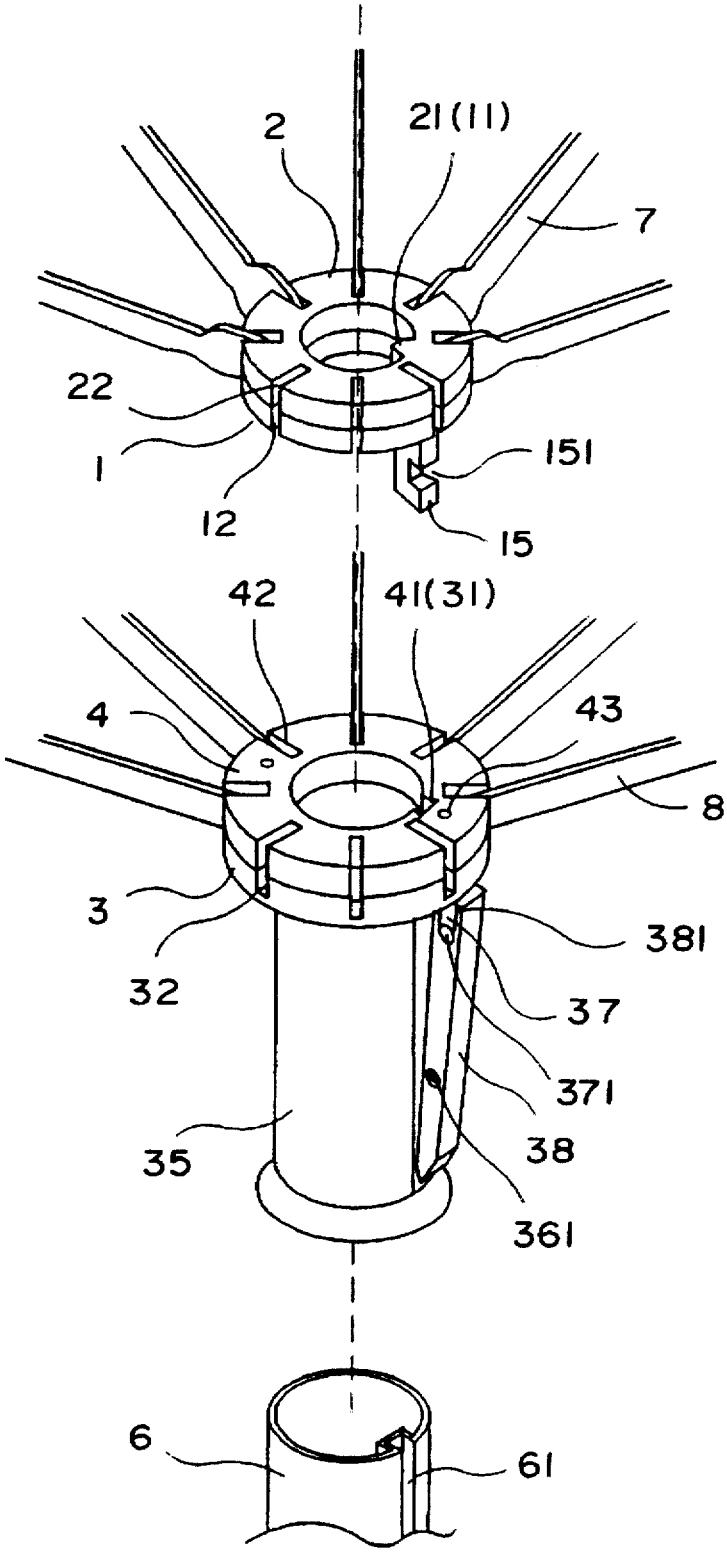
FIG. 2 is an perspective showing the manner in which the upper hub member, the lower hub member, and the umbrella stick are assembled.
Figure 3:
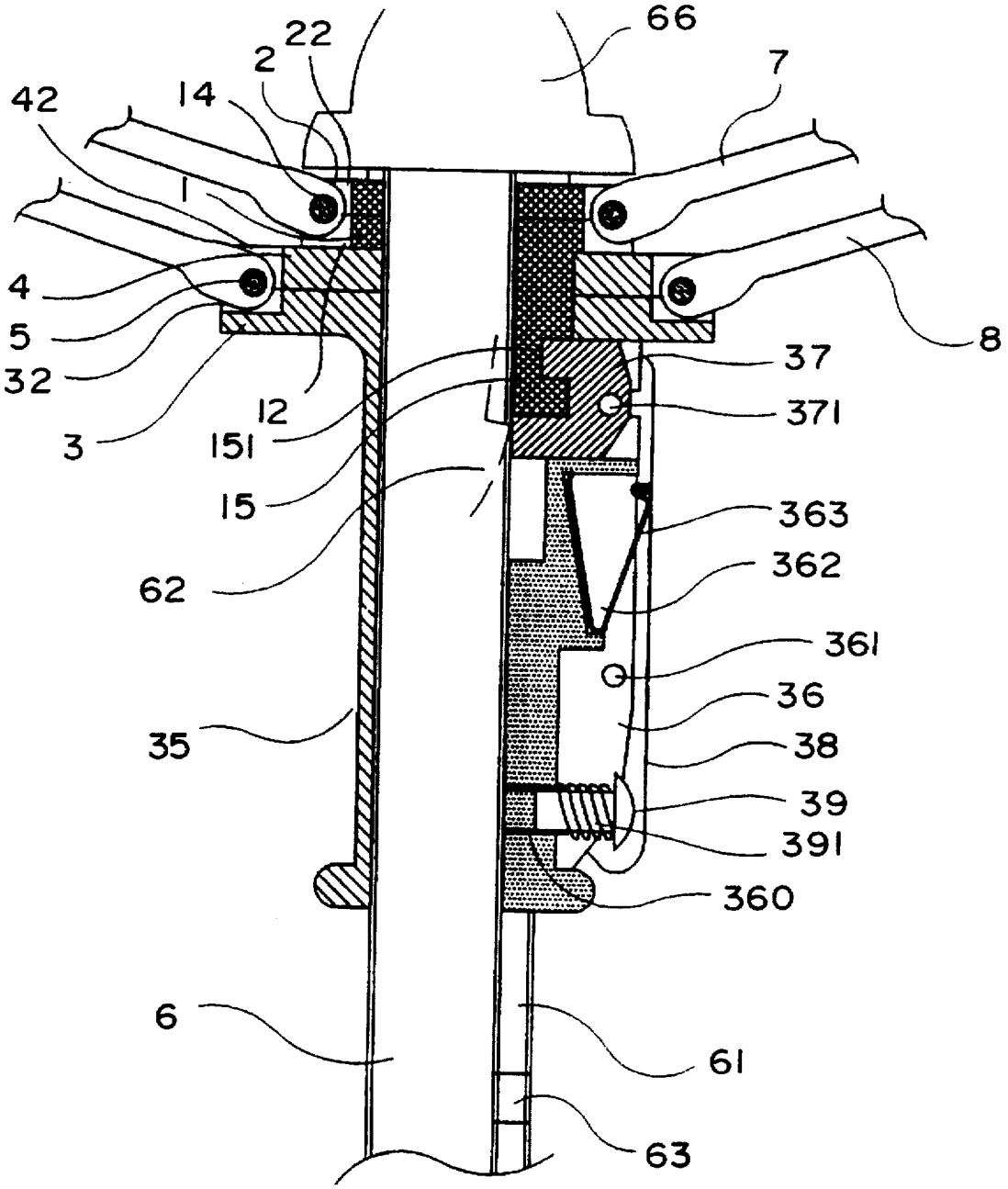
FIG. 3 is a fragmentary, enlarged, assembled, and sectional view of the present invention.

Please refer to FIGS. 1, 2, and 3. The present invention relates to an umbrella with a stretch structure for selectively collecting rainwater and mainly includes an upper hub member 1, an upper hub cover 2, a lower hub member 3, a lower hub cover 4, a plurality of umbrella main ribs 7, a plurality of steel pins 14, a plurality of secondary ribs 8, a steel wire ring 5 having an opening, a push-button switch 38, a stick 6, and an umbrella cover The upper and the lower hub members 1, 3 are up and down movably put around the stick 6 and can be retained to predetermined positions on the stick 6.

The upper hub member 1 has a central opening and is designed to fix the umbrella main ribs 7 therearound. To do this, the upper hub member 1 is provided at a peripheral surface with a plurality of radially arranged vertical grooves 12 and on a top surface with a plurality of receiving recesses 121. Each of the receiving recesses 121 extends across a top of one of the vertical grooves 12 to receive a steel pin 14 therein. A retaining block 15 having a facing-outward opening 151 downward extends from a bottom surface of the upper hub member 1. An inward projection 11 is provided to one side of the central opening.

The upper hub cover 2 also has a central opening corresponding to the central opening of the upper hub member and is formed at a peripheral surface with a plurality of radially arranged vertical grooves 22 to each correspond to a vertical grooves 12 on the upper hub member 1. The upper hub cover 2 is also provided at a bottom surface with a plurality of receiving recesses 221 corresponding to the receiving recesses 121 of the upper hub member 1 so as to retain the steel pins 14 between the closed upper hub member 1 and upper hub cover 2. To close the upper hub member 1 and the upper hub cover 2 together, protuberances 13 are provided on the top surface of the upper hub member 1 and dents 23 are correspondingly provided on the bottom surface of the upper hub cover 2 to engage with the protuberances 13. An inward projection 21 is provided to one side of the central opening corresponding to the projection 11 of the upper hub member 1.

The lower hub member 3 has a central opening and is designed to fix the secondary ribs 8 therearound. To do this, the lower hub member 3 is provided at a peripheral surface with a plurality of radially arranged vertical grooves 32 and on a top surface with an annular groove 34. The annular groove 34 extends across a top of every vertical grooves 32 to receive the steel wire ring 5 therein. The vertical grooves 32 have a depth about one half of a depth of the lower hub member 3 so that the secondary ribs 8 are separately supported in the vertical grooves 32 without falling out of or declining from the lower hub member 3. A dent 31 is provided to one side of the central opening for fitly receiving the downward extended retaining block 15 of the upper hub member 1.

An elongated tube portion 35 extends from a bottom side of the lower hub member 3 to facilitate the movement of the lower hub member 3 toward or away from the upper hub member 1. The elongated tube portion 35 is provided at one side with a vertically extended seat 36. The push-button switch 38 is fixed in the seat 36 by means of a supporting shaft 361 threading through the seat 36 and the push-button switch 38. To allow the switch 38 to return to an outer home position after it is pushed inward, a V-shaped spring member 363 is disposed in a recess 362 formed in the seat 36 to abut one leg thereof against an inner side of the push-button switch 38. A control block 37 is pivotally supported on a top long slot 381 of the switch 38 by locating two sideward projected pins 371 thereof in two side slots formed at top end of the switch 38. The control block 37 has a configuration and a position just allow it to engage with the side opening 151 of the downward extended retaining block 15 of the upper hub member 1. A through hole 360 is formed near a lower end of the tube portion 35 so that a push pin 39 with a spring 391 put around it can extend through the hole 360 to move in and out laterally.

The lower hub cover 4 also has a central opening corresponding to the central opening of the lower hub member and is formed at a peripheral surface with a plurality of radially arranged vertical grooves 42 to each correspond to a vertical grooves 32 on the lower hub member 3. The lower hub cover 4 is also provided at a bottom surface with an annular groove 44 corresponding to the annular groove 34 of the lower hub member 3 so as to retain the steel wire ring 5 between the closed lower hub member 3 and lower hub cover 4. To close the lower hub member 3 and the lower hub cover 4 together, studs 33 are provided on the top surface of the lower hub member 3 and locating holes 43 are correspondingly provided on the bottom surface of the lower hub cover 4 to engage with the studs 33. A dent 41 is provided to one side of the central opening corresponding to the dent 31 of the lower hub member 3 for the retaining block 15 to pass through. And, to allow the steel wire ring 5 to firmly locate between the annular grooves 34 and 44, raised portions 341 and 441 are respectively formed in the annular grooves 34, 44 to engage with the opening on the ring 5.

The umbrella main ribs 7 are pivotally connected to the closed upper hub member 1 and upper hub cover 2 by extending the steel pins 14 through holes 71 formed at their inner ends and then locating the ribs 7 in the vertical grooves 12 with the steel pins in the receiving recesses 121, and finally closing the upper hub cover 2 over the upper hub member 1 with the bottom ends 23 engaging with the protuberances 13.

Similarly, the secondary ribs 8 are pivotally connected to the closed lower hub member 3 and lower hub cover 4 by extending the steel wire ring 5 through holes 81 formed at their inner ends and then locating the secondary ribs 8 in the vertical grooves 32 with the ring 5 in the annular groove 34, allowing the opening of the ring 5 to align with the raised portion 341, and finally closing the lower hub cover 4 over the lower hub member 3 with the bottom locating holes 43 engaging with the studs 33.

The umbrella stick 6 is formed on an outer surface with an axially extended channel 61 to receive the projections 11, 21 formed at one side of the central openings of the upper hub member 1 and the upper hub cover 2, so that the closed upper hub member 1 and upper hub cover 2 may be guided by the channel 61 to slide along the stick 6. The stick 6 is also formed near an upper portion with a springy retaining hook 62 to retain the upper hub member 1 to a top portion of the stick 6. An upper through hole 63 is formed on the stick 6 below the springy retaining hook 62 and a lower through hole 64 is formed at a lower portion of the stick 6 slightly above a handle 65 of the umbrella for the push pin 39 to extend into and thereby locates the lower hub member 3 at a higher or a lower position on the stick 6 as required.

Figure 4:
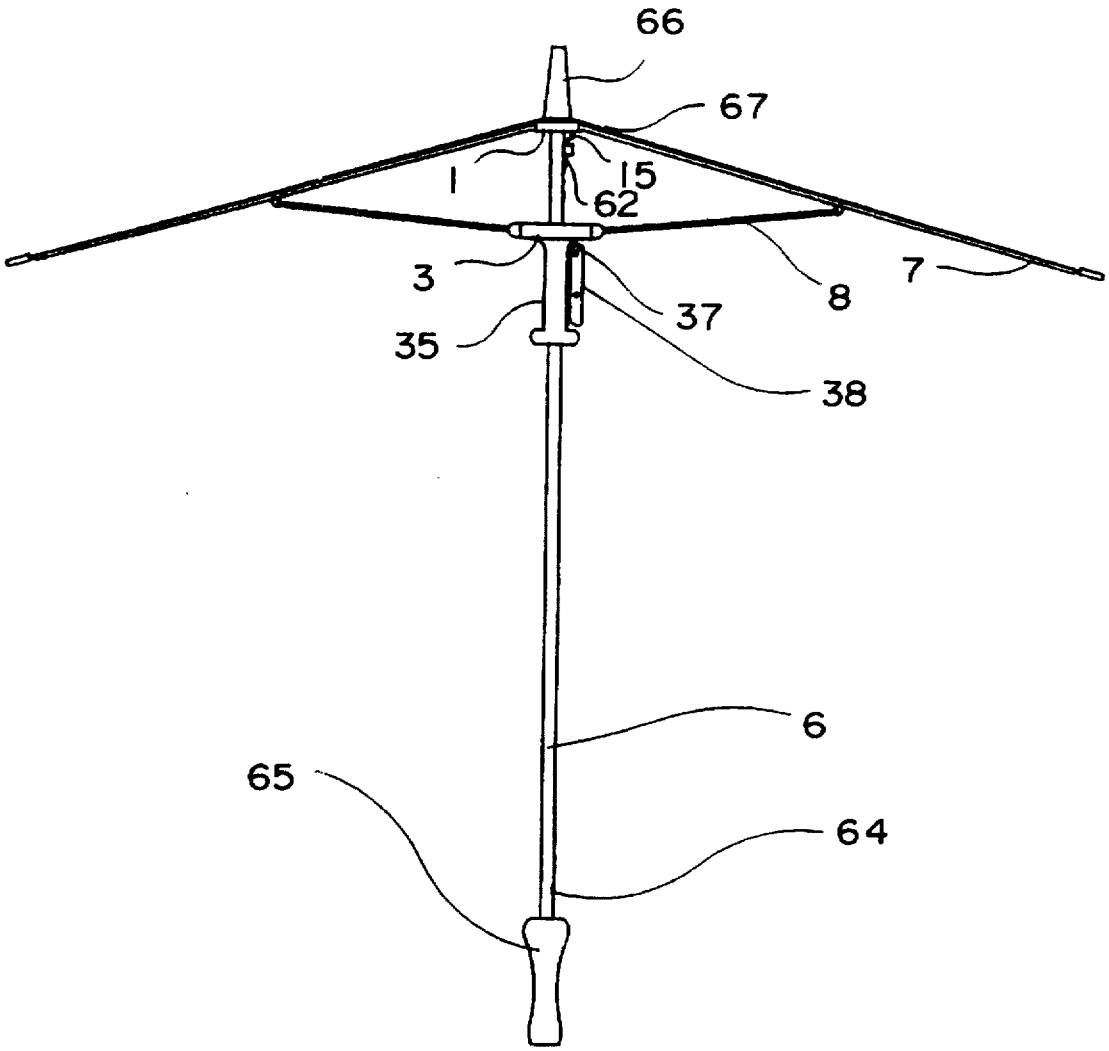
FIG. 4 is a schematic view showing an umbrella according to the present invention in a stretched state.

Please now refer to FIGS. 3 and 4 at the same time. A top cap 66 is used to fix and center the umbrella cover 67 at a top end of the stick 6. An outer periphery of the umbrella cover 67 is fixed to outer ends of the main ribs 7. Outer ends of the secondary ribs 8 are connected to a middle portion of the umbrella cover 67 by sewing. To stretch the umbrella, first push up the lower hub member 3 and the upper hub member 1 until they reach the top end of the stick 6. Then, press a lower portion of the push-button switch 38 inward so that the control block 37 disengages from the retaining block 15 of the upper hub member 1. At this point, the springy retaining hook 62 on the stick 6 below the retaining block 15 shall spring outward to press against a bottom of the retaining block 15, preventing the upper hub member 1 from sliding downward. Then, grip at the tube portion 35 to pull down the lower hub member 3 to pass the upper through hole 63, allowing the push pin 39 to extend into the through hole 63 and thereby locating the lower hub member 3 thereto.

Figure 5:
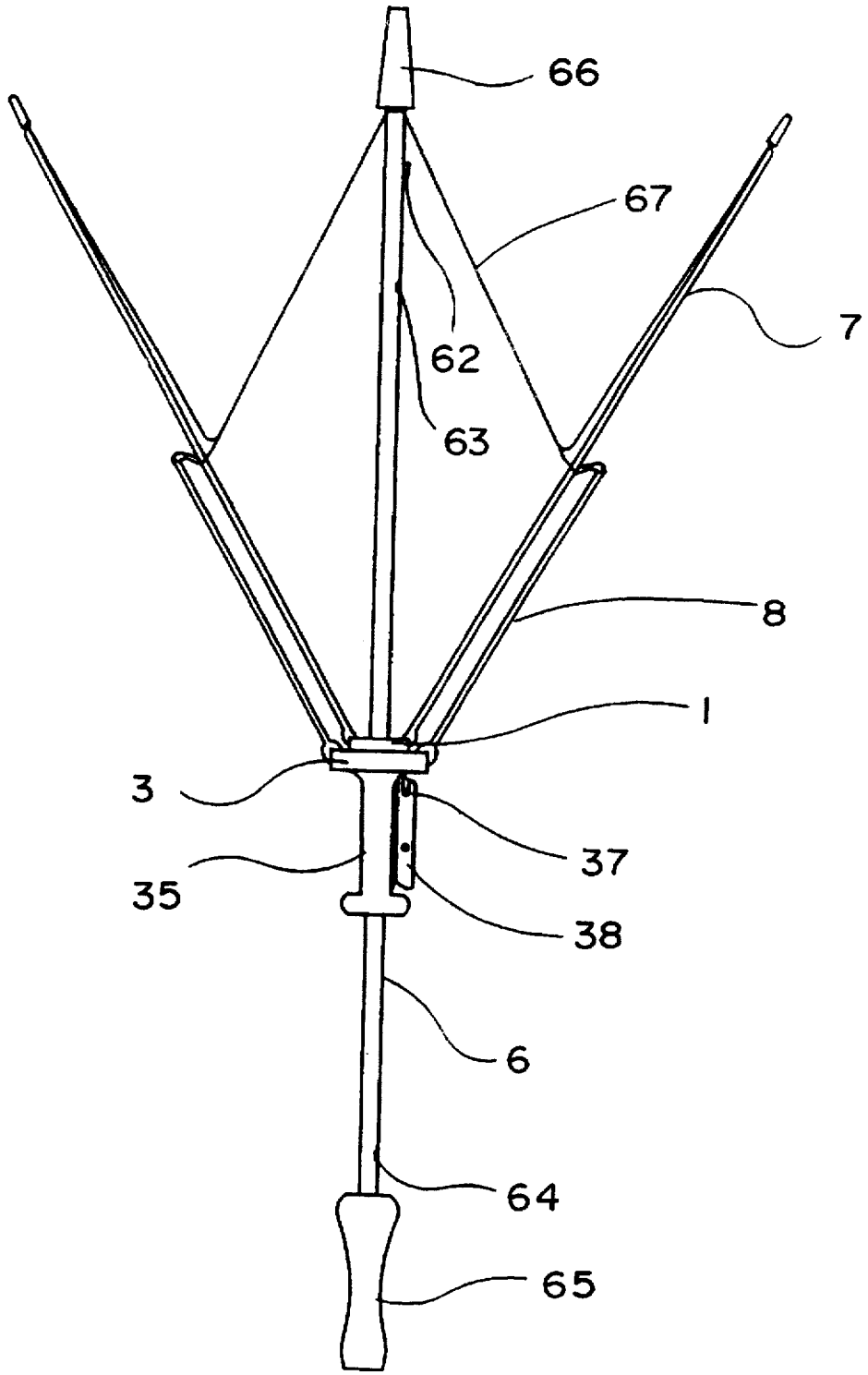
FIG. 5 is a schematic view showing the umbrella according to the present invention in a rainwater collecting state.

Please refer to FIG. 5 for the manner in which the umbrella is folded from a stretched state to collect rainwater. To collect rainwater attached to the umbrella cover 67, first push the lower hub member 3 upward to contact with the upper hub member 1 again, allowing the control block 37 of the push-button switch 38 to engage with the retaining block 15 and thereby locking the upper and the lower hub members 1, 3 together. At this point, the springy retaining hook 62 returns to its retreated position in the stick 6. Then, pull down the locked upper and lower hub members 1, 3 at the same time, bringing the umbrella cover 67 to fold at its joint with the secondary ribs 8 and looks like a letter "W" when viewing sideward. At this point, rainwater attached to the umbrella cover 67 shall flow downward and be collected within a room defined by the folded umbrella cover 67. Keep pulling the tube portion 35 downward until the push pin 39 in the vertical seat 36 passes and extends into the lower through hole 64 slightly above the handle 65, retaining the locked upper and lower hub members 1 and 3 thereto.

Figure 6:
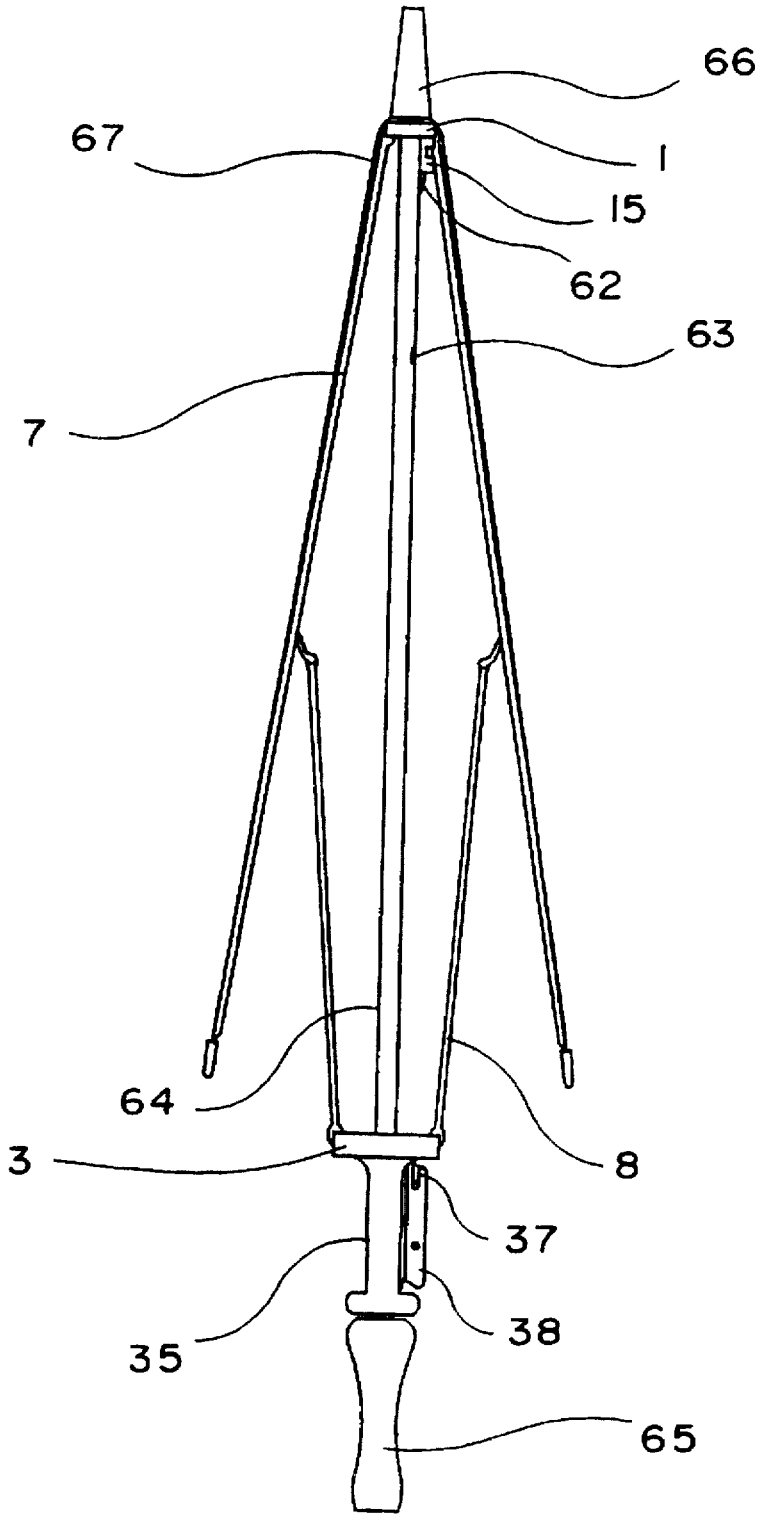
FIG. 6 is a schematic view showing the umbrella according to the present invention in a closed state.
Figure 7:
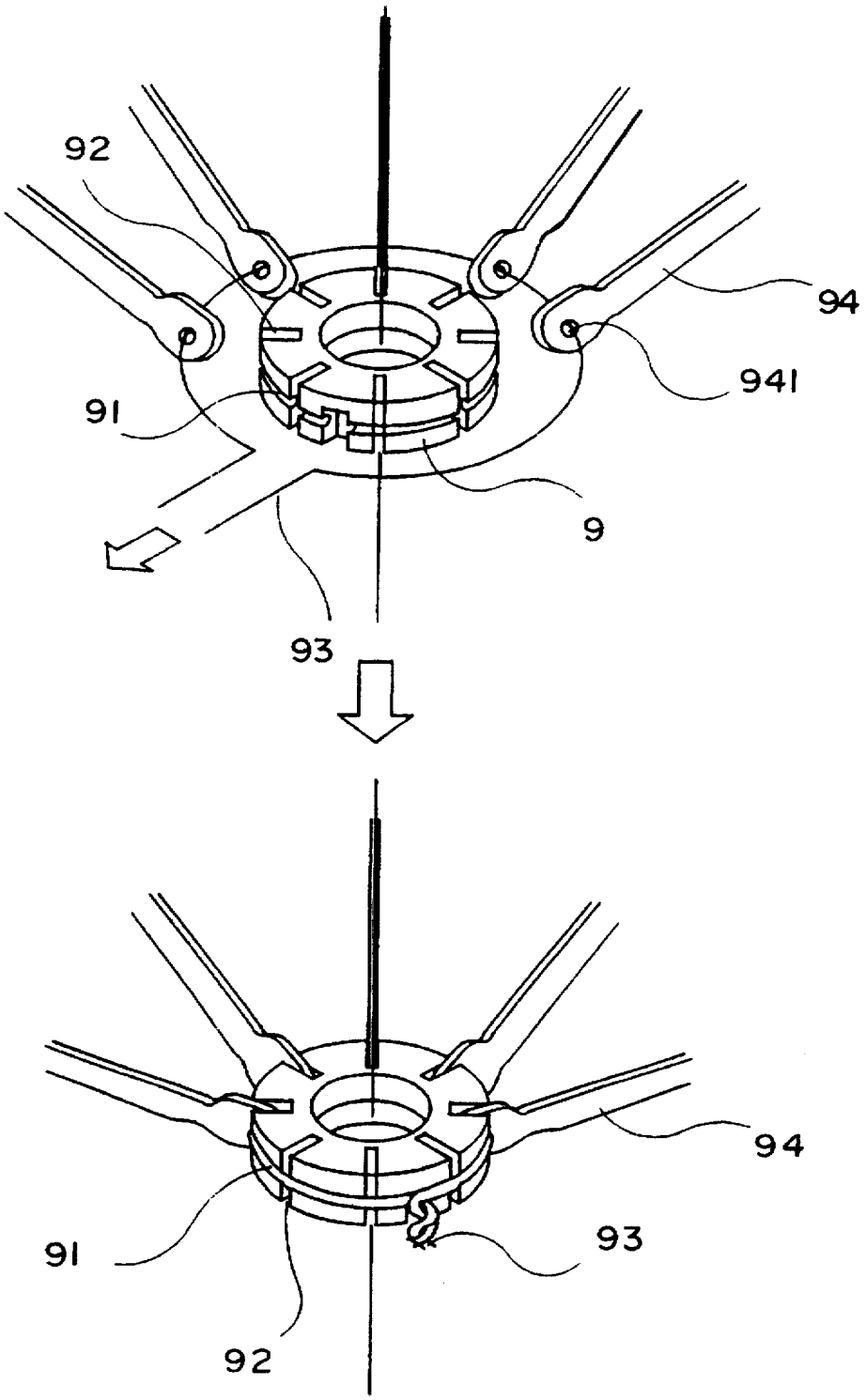
FIG. 7 (PRIOR ART)
FIG. 7 illustrates the manner in which the hub member and the ribs of a conventional umbrella are assembled.

FIG. 6 illustrates the umbrella of the present invention is closed without folding the umbrella cover 67 to collect rainwater. To do so, first push the upper and the lower hub member 1, 3 upward to the top end of the stick 6 below the top cap 66. Then, disengage the control block 37 from the retaining block 15. At this point, the springy retaining hook 62 springs out to press against the bottom of the retaining block 15. Grip the elongated tube portion 35 to pull the lower hub member 3 down at this time, allowing the push pin 39 in the vertical seat 36 of the enlongated tube portion 35 to extend into the lower through hole 64 on the stick 6.

With above arrangements, any damaged umbrella main rib 7 or secondary rib 8 can be easily and quickly replaced with a new one; the steel pins 14 and the steel wire ring 5 allow the ribs 7 and 8 to pivotally turn relative to the upper and the lower hub members 1 and 3, respectively, in a more smooth manner without the risk of piercing the umbrella cover 67 and thereby prolong the usable life of the umbrella. Moreover, the umbrella can be closed in different manner as required, that is, to be conveniently and quickly closed in a folded manner to collect rainwater or in a normal manner not to collect rainwater. And the folded umbrella can be stretched for the next use at any time without the need to drain the collected water.

What is claimed is:

1. An umbrella with a stretch structure for selectively collecting rainwater, comprising an upper hub member, an upper hub cover disposed on said upper hub member, a lower hub member, a lower hub cover disposed on said lower hub member, a plurality of umbrella main ribs, a plurality of steel pins, a plurality of secondary ribs, a steel wire ring having an opening, a push-button switch having a control block pivotally connected to a top thereof, a stick having an axially extended channel, and an umbrella cover;

said upper and said lower hub members as well as said upper and said lower hub covers all having a central opening while said upper hub member and said upper hub cover further having an inward projection provided at one side of their respective central opening, and said upper and said lower hub members as well as said upper and said lower hub covers being up and down movably put around said stick with said inward projections engaging into said axial channel of said stick;

said upper hub member and said upper hub cover being correspondingly provided at a peripheral surface with a plurality of radially arranged vertical grooves and on a top and a bottom surface, respectively, with a plurality of shallow receiving recesses, each of said receiving recesses extending across a top of one of said vertical grooves to receive one of said steel pins therein while said steel pins respectively threading through a hole formed at an inner end of said umbrella main ribs to pivotally connect said main ribs to said vertical grooves of said upper hub member and said upper hub cover, and a retaining block having a facing-outward opening downward extending from a bottom surface of said upper hub member;

said lower hub member and said lower hub cover being correspondingly provided at a peripheral surface with a plurality of radially arranged vertical grooves and on a top and a bottom surface, respectively, with a shallow annular groove having a raised portion, said annular groove extending across a top of every said vertical grooves to receive said steel wire ring therein with said raised portions engaging with said opening of said steel wire ring, said steel wire ring threading through a hole formed at an inner end of said secondary ribs to pivotally connect said secondary ribs to said vertical grooves of said lower hub member and said lower hub cover, said vertical grooves on said lower hub member having a depth about one half of a depth of said lower hub member so that said secondary ribs are separately supported in said vertical grooves of said lower hub member without falling out of or declining from said lower hub member, said lower hub member and said lower hub cover both having a dent provided to one side of their central opening for fitly receiving said downward extended retaining block of said upper hub member; said lower hub member having a downward extended elongated tube portion to allow said lower hub member to be more easily moved toward or away from said upper hub member, said elongated tube portion being provided at one side with a vertically extended seat to receive said push-button switch therein by means of a supporting shaft threading through said seat and said push-button switch, said vertical seat having a V-shaped spring member disposed in a recess formed therein so that a leg of said spring member abuts against an inner side of said push-button switch to allow said switch to return to an outer home position after it is pushed inward; a control block being pivotally supported on a top of said switch and having a configuration and a position just allowing it to engaging with said downward extended retaining block of said upper hub member; a through hole being formed near a lower end of said vertical seat so that a push pin with a spring put therearound extends through said through hole to move in and out laterally;

said umbrella cover being fixed to and centered at a top end of said stick with an outer periphery thereof fixed to outer ends of said main ribs and a middle portion thereof connected to outer ends of said secondary ribs by sewing; and said stick being formed near an upper portion with a springy retaining hook to press against a bottom of said retaining block of said upper hub member and thereby retain said upper hub member to an upper place on said stick when said retaining block is not engaged with said control block of said push-button switch, said stick further having an upper through hole formed below said springy retaining hook and a lower through hole formed at a lower portion of said stick slightly above a handle of said umbrella for said push pin to extend into and thereby locates said lower hub member at a higher or a lower position on said stick as required;

whereby when said upper and said lower hub member are pushed up until they reach the top end of said stick and said upper hub member is retained thereto by said springy retaining hook and said lower hub member is disengaged from said upper hub member and pulled down to be located at said upper through hole of said stick, said umbrella is stretched; when said lower hub member alone is pulled down to be located at said lower through hole on said stick, said umbrella is closed in a normal manner; and when said upper and said lower hub members are locked together by the engaged retaining block and control block and are pulled down together to located at said lower through hole on said stick, said umbrella is closed with said umbrella cover in a folded state for collecting rainwater attached to said umbrella cover.

* * * * *